US010669115B2

(12) United States Patent
Miyashita

(10) Patent No.: US 10,669,115 B2
(45) Date of Patent: Jun. 2, 2020

(54) APPARATUS FOR PREPROCESSING PAPER SHEETS AND METHOD FOR PROCESSING PAPER SHEETS

(71) Applicants: Kabushiki Kaisha Toshiba, Tokyo (JP); Toshiba Infrastructure Systems & Solutions Corporation, Kanagawa (JP)

(72) Inventor: Morimasa Miyashita, Kanagawa (JP)

(73) Assignees: Kabushiki Kaisha Toshiba, Tokyo (JP); Toshiba Infrastructure Systems & Solutions Corporation, Kanagawa (JP)

( * ) Notice: Subject to any disclaimer, the term of this patent is extended or adjusted under 35 U.S.C. 154(b) by 0 days.

(21) Appl. No.: 15/708,796

(22) Filed: Sep. 19, 2017

(65) Prior Publication Data

US 2018/0079618 A1 Mar. 22, 2018

(30) Foreign Application Priority Data

Sep. 20, 2016 (JP) ..... 2016-183071

(51) Int. Cl.
*G07D 11/22* (2019.01)
*B65H 43/08* (2006.01)
(Continued)

(52) U.S. Cl.
CPC ..... *B65H 43/08* (2013.01); *B07C 5/12* (2013.01); *B07C 5/28* (2013.01); *B07C 5/3422* (2013.01);
(Continued)

(58) Field of Classification Search
CPC .... B07C 5/02; B07C 5/12; B07C 5/16; B07C 5/28; B07C 5/34; B07C 5/342;
(Continued)

(56) References Cited

U.S. PATENT DOCUMENTS 4,414,730 A * 11/1983 Ohmura ..... G07D 11/00 209/534
4,447,885 A * 5/1984 Biss ..... G01G 19/414 177/200
(Continued)

FOREIGN PATENT DOCUMENTS

| | | | |
|---|---|---|---|
| GB | 2155190 | A | 9/1985 |
| JP | 2015180982 | A | 10/2015 |
| WO | 2009040941 | A1 | 4/2009 |

OTHER PUBLICATIONS

Extended European Search Report issued in related EP Application No. EP 17191680, dated Jan. 31, 2018, 11 pages.

*Primary Examiner* — Joseph C Rodriguez
(74) *Attorney, Agent, or Firm* — Baker Botts L.L.P.

(57) ABSTRACT

Paper sheets preprocessing apparatus includes a material remover, a detector, a controller, and a display. The material remover removes a material from a paper sheets assembly. The paper sheets assembly includes a plurality of paper sheets strapped by the material. The detector is located at an upstream side than the material remover, and detects information of the paper sheets assembly. The controller decides whether the paper sheets assembly satisfies a predetermined specification, based on the information detected by the detector. If the controller decides that the paper sheets assembly does not satisfy the predetermined specification, the display displays a reason to decide that the paper sheets assembly does not satisfy the predetermined specification.

8 Claims, 7 Drawing Sheets

(51) Int. Cl.

| | |
|---|---|
| ***B65B 69/00*** | (2006.01) |
| ***G07D 11/16*** | (2019.01) |
| ***B07C 5/12*** | (2006.01) |
| ***B07C 5/28*** | (2006.01) |
| ***B07C 5/342*** | (2006.01) |
| ***B65H 37/00*** | (2006.01) |

(52) U.S. Cl.
CPC ..... *B65B 69/0025* (2013.01); *B65H 37/00* (2013.01); *G07D 11/16* (2019.01); *G07D 11/22* (2019.01)

(58) Field of Classification Search
CPC ..... B07C 2501/0036; G07D 7/181; G07D 7/189; G07D 7/20; G07D 7/2075; G07D 11/0066; G07D 11/0084
USPC ..... 209/534; 194/206, 207, 229
See application file for complete search history.

(56) References Cited

U.S. PATENT DOCUMENTS 4,674,060 A * 6/1987 Larkin ..... G07D 11/0084 177/200
4,722,443 A 2/1988 Maruyama et al.
5,090,573 A * 2/1992 Takahashi ..... B65B 69/0025 209/534
5,193,629 A * 3/1993 Lare ..... G01G 19/42 177/200
6,098,373 A * 8/2000 Ashikawa ..... B65B 69/0025 53/381.2
6,502,052 B1 * 12/2002 Someya ..... G06M 9/00 235/379
RE38,663 E * 11/2004 Kayani ..... G06K 9/00 209/534
8,393,472 B2 * 3/2013 Hayduchok ..... B07C 5/02 209/3.2
8,811,710 B2 * 8/2014 Demmeler ..... B65B 69/0025 382/135
9,042,632 B2 * 5/2015 Petker ..... G06M 9/00 382/135
9,613,481 B2 * 4/2017 Jacomet ..... G07D 11/0066
9,731,849 B1 * 8/2017 Ito ..... B65B 27/08
2003/0168308 A1 9/2003 Maier et al.
2014/0260115 A1 9/2014 Mayhall, III et al.
2016/0264278 A1 9/2016 Hirose et al.

* cited by examiner

APPARATUS FOR PREPROCESSING PAPER SHEETS AND METHOD FOR PROCESSING PAPER SHEETS

CROSS-REFERENCE TO RELATED APPLICATION

This application is based upon and claims the benefit of priority from Japanese Patent Application No. 2016-183071, filed on Sep. 20, 2016; the entire contents of which are incorporated herein by reference.

FIELD

Embodiments described herein relate generally to an apparatus for preprocessing paper sheets and a method for processing paper sheets.

BACKGROUND

As to paper sheets transported as a paper sheets assembly (a plurality of paper sheets is strapped by a material (band)), in order to process each paper sheet (one by one) by a paper sheets processing machine, preprocessing to remove the material is necessary. However, if the paper sheets assembly does not satisfy a predetermined specification, when preprocessing of the paper sheets assembly is performed or when paper sheets are processed by a processing machine of the paper sheets processing machine, various defects often occur. Accordingly, an operator's manual operation is required to remove the defects. As a result, in order to process the paper sheets by the paper sheets processing machine, many times and labors are necessary for the operator.

DETAILED DESCRIPTION

According to one embodiment, paper sheets preprocessing apparatus includes a material remover, a detector, a controller, and a display. The material remover removes a material from a paper sheets assembly. The paper sheets assembly includes a plurality of paper sheets strapped by the material. The detector is located at an upstream side than the material remover, and detects information of the paper sheets assembly. The controller decides whether the paper sheets assembly satisfies a predetermined specification, based on the information detected by the detector. If the controller decides that the paper sheets assembly does not satisfy the predetermined specification, the display displays a reason to decide that the paper sheets assembly does not satisfy the predetermined specification.

Hereinafter, a paper sheets preprocessing apparatus and a paper sheets processing method according to one embodiment will be explained by referring to drawings. In following embodiment, a paper sheets preprocessing machine 5 will be explained. The paper sheets preprocessing machine 5 functions as the paper sheets preprocessing apparatus of one embodiment. For example, paper sheets P are banknotes. However, the paper sheets are not limited to the banknotes.

Figure 1:
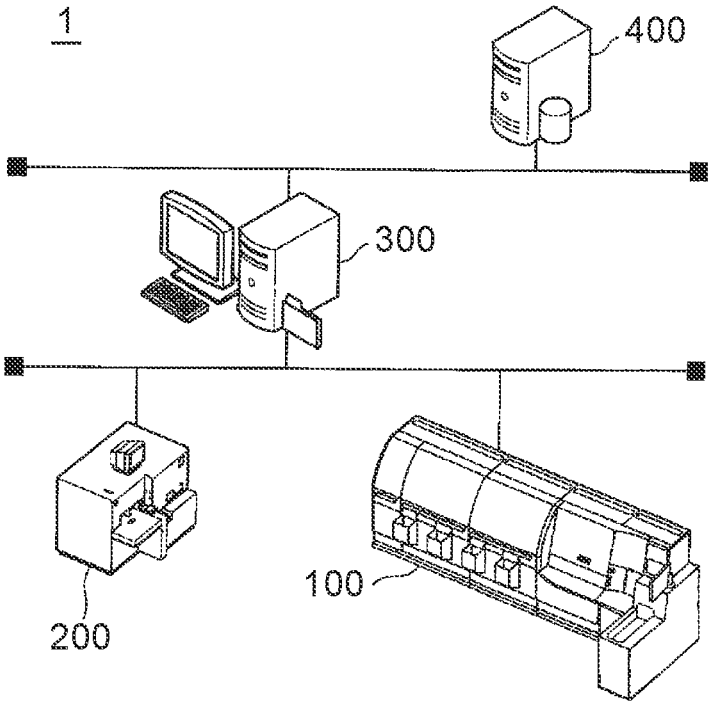
FIG. 1 is a block diagram of a paper sheets verification system according to one embodiment.

First, a paper sheets verification system 1 of one embodiment will be explained. FIG. 1 is a block diagram of the paper sheets verification system 1 of one embodiment. As shown in FIG. 1, the paper sheets verification system 1 includes a processing machine 100 (of at least one paper sheets processing machine), a checking machine 200, a paper sheets verification machine 300, and a host server 400. The paper sheets processing machine includes the paper sheets preprocessing machine 5 (explained afterward) and the processing machine 100. The processing machine 100, the checking machine 200 and the paper sheets verification machine 300 are connected via a network such as LAN (Local Area Network).

Figure 2:
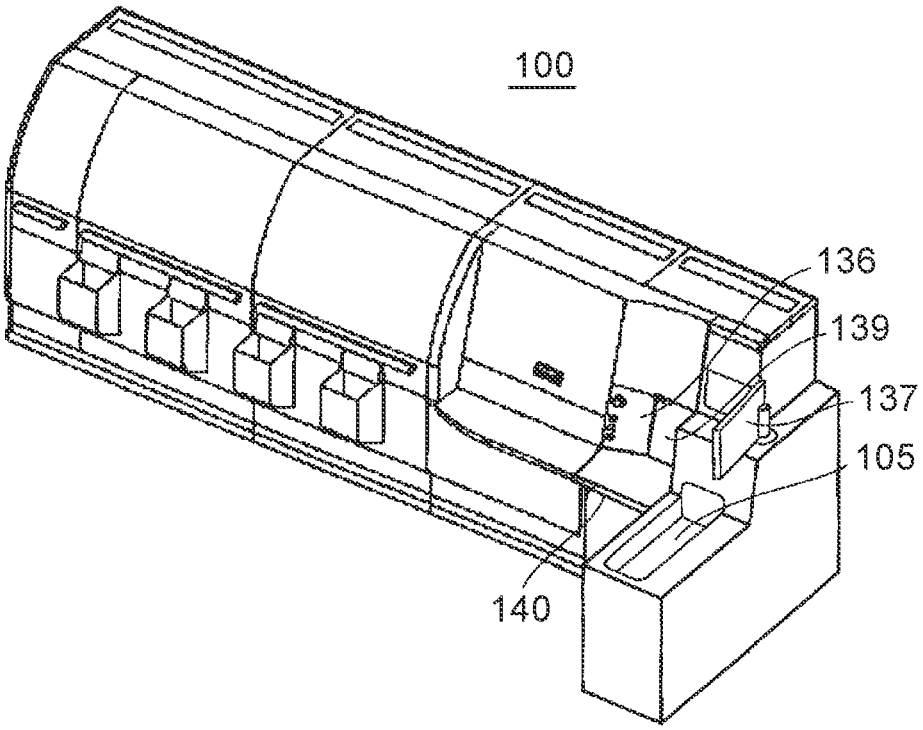
FIG. 2 is an appearance perspective diagram of a processing machine according to one embodiment.

FIG. 2 is an appearance perspective diagram of the processing machine 100. As shown in FIG. 2, the processing machine 100 equips a paper sheets feeder 105, an operation device 136, an operation display 137, an output pocket 139 and a keyboard 140, at the outside thereof. The operation device 136, the operation display 137 and the keyboard 140 are operated by an operator, and arbitrarily sets a denomination (such as a type of banknote) of paper sheets P to be processed by the processing machine 100. The paper sheets P are supplied to the paper sheets feeder 105 by the paper sheets preprocessing machine 5 (explained afterward). Moreover, the paper sheets feeder 105 is not limited to a form shown in FIG. 2, and may equip a feeder guide. Furthermore, loose paper sheets (preprocessed by the paper sheets preprocessing machine 5) and a secondary batch separator card BC-2 (explained afterward) may be stacked and fed. The processing machine 100 takes out a plurality of (laminated) paper sheets P one by one, and inspects each of the plurality of paper sheets P. Based on this inspection result, the processing machine 100 rejects paper sheets P satisfying a predetermined condition as rejected notes among the plurality of paper sheets P. The rejected paper sheets P can be taken out from the output pocket 139.

The checking machine 200 re-inspects the rejected notes (rejected by the processing machine 100 one time) more accurately at a lower speed than the paper sheets processing machine 100. The checking machine 200 sends the re-inspection result to the paper sheets verification machine 300. The paper sheets verification machine 300 stores strap information (sent by the paper sheets preprocessing machine 5), the inspection result by the processing machine 100, and the re-inspection result by the checking machine 200 correspondingly. The host server 400 manages and accumulates the information acquired by the paper sheets verification machine 300 from the processing machine 100 or the checking machine 200.

Figure 3:
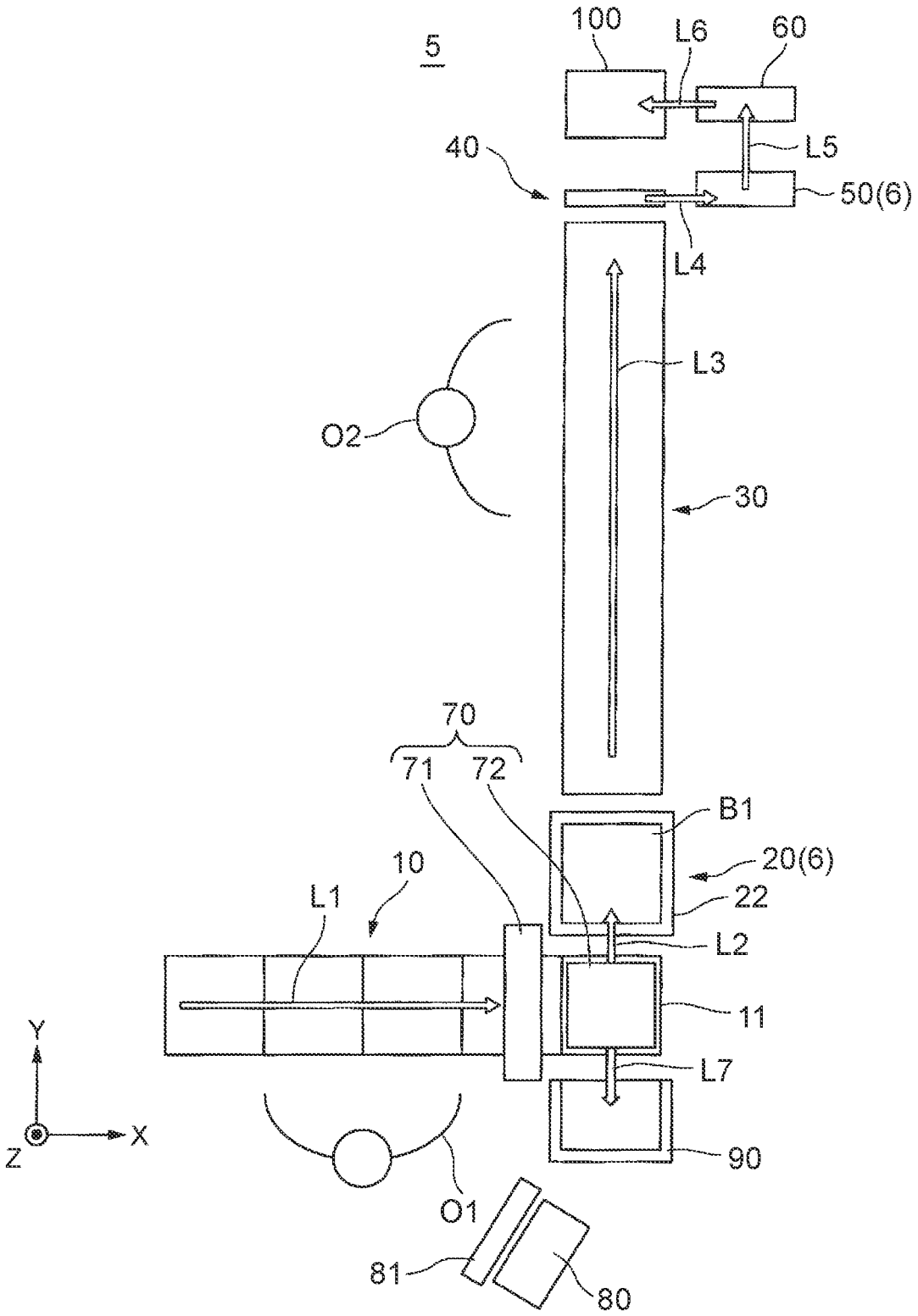
FIG. 3 is a schematic diagram showing outline configuration of a paper sheets preprocessing apparatus according to one embodiment.
Figure 4:
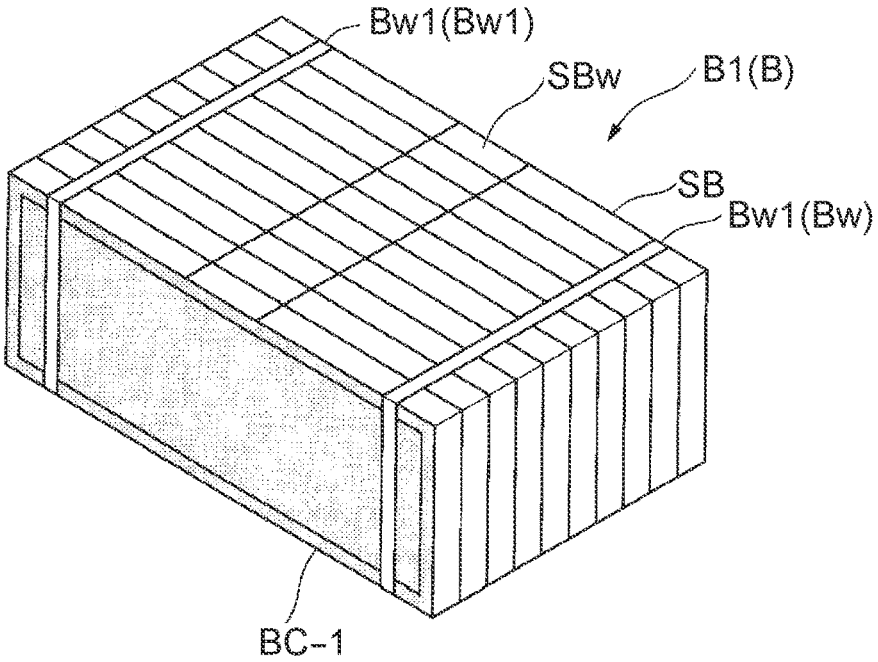
FIG. 4 is a perspective diagram showing a bundle satisfying a specification according to one embodiment.
Figure 5:
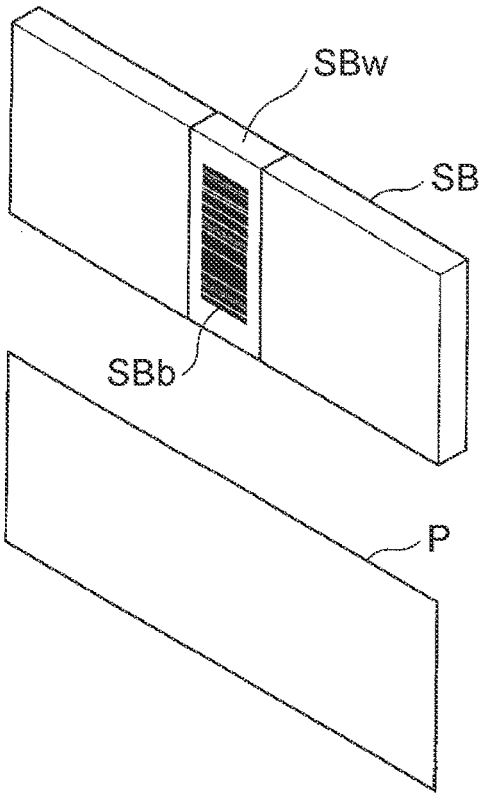
FIG. 5 is a perspective view showing a strap and a paper sheet according to one embodiment.

FIG. 3 is a schematic diagram showing outline configuration of the paper sheets preprocessing machine 5 according to one embodiment. FIG. 4 is a perspective diagram showing a bundle B1 satisfying a specification according to one embodiment. FIG. 5 is a perspective view showing a strap SB and a paper sheet P according to one embodiment. In FIG. 3, Z-axis direction is in parallel with a vertical direction. X-axis direction and Y-axis direction are respectively one direction among horizontal directions orthogonal to Z-axis direction. X-axis direction and Y-axis direction are orthogonal mutually.

The paper sheets preprocessing machine 5 shown in FIG. 3 functions as a preprocessing machine for performing preprocessing to transfer the paper sheets P to the processing machine 100. In the paper sheets preprocessing machine 5 of the present embodiment, a paper sheets assembly (a plurality of paper sheets P is strapped by a material) is fed by an operator O1. The paper sheets preprocessing machine 5 releases strapping of the paper sheets assembly, and separates the paper sheets P one by one. In following explanation, in a processing flow from feeding of the paper sheets assembly (into the paper sheets preprocessing machine 5) to transferring of the paper sheets P (to the processing machine 100), a side to feed the paper sheets assembly is called "an upstream side", and a side to transfer the paper sheets P to the processing machine 100 is called "a downstream side".

In the present embodiment, the paper sheets assembly is a bundle B shown in FIG. 4. Materials (bands) to strap the paper sheets P of the bundle B include a strapping material SBw to strap a plurality of paper sheets P as a strap SB, and a bundling material Bw to bundle a predetermined number of straps SB as a bundle B. The bundle B is composed by bundling the predetermined number of straps SB by the bundling material Bw, and each strap SB is composed by strapping a plurality of paper sheets P by the strapping material SBw. For example, the bundle B is composed of ten straps SB. In the bundle B shown in FIG. 4, a primary batch separator card BC-1 to discriminate the bundle B is bundled with the predetermined straps SB. The bundle B shown in FIG. 4 is a proper bundle B1 satisfying a specification of the bundle B (explained afterward). The bundling material Bw shown in FIG. 4 is a proper bundling material Bw1 satisfying a specification of the bundle B.

As shown in FIG. 5, the strapping material SBw is wound around a short side direction and a thickness direction of a plurality of paper sheets P (laminated along the thickness direction) to strap the plurality of paper sheets P. In FIG. 5, the strapping material SBw is wound at a center of a long side direction of the plurality of paper sheets P. For example, the strapping material SBw is a binding material such as a paper strip. A bar code SBb is put on the strapping material SBw. Information embedded into the bar code SBb is strap information common to a plurality of paper sheets P strapped by a strap SB. The strap information is information of each strap SB such as a strap number (to discriminate the strap SB), a bank name, a branch name, a handling person, a handling date and time. In the present embodiment, the bar code SBb is put on the strapping material SBw. However, the strap information may be printed as characters on the strapping material SBw.

As shown in FIG. 4, the bundling material Bw1 is wound around a short side direction and a thickness direction of a plurality of straps SB (laminated along the thickness direction) to bundle the plurality of straps SB. In FIG. 4, two bundling materials Bw1 are set to one bundle B1. The two bundling materials Bw1 are respectively wound at both ends of a long side direction of the plurality of straps SB. For example, the bundling material Bw1 is an extendable binding material such as an elastic band. Furthermore, the bundling material Bw1 may be a paper strip or a plastic band such as polypropylene.

As shown in FIG. 3, the paper sheets preprocessing machine 5 equips a bundle feeder 10, a reject tray (stacker) 90, a material remover 6, a strap connection part 30, a strap picking part 40, a strap stacker 60, a detector 70, a controller 80, and a display part 81.

The bundle feeder 10 is a part to feed the bundle B by the operator O1. The bundle feeder 10 equips a conveyance base composing a transport path L1 to transport the bundle B. For example, the transport path L1 is extended along a predetermined direction (X-axis direction) orthogonal to a vertical direction (Z-axis direction). The bundle b carried on the conveyance base of the bundle feeder 10 is transported along the transport path L1. For example, on the conveyance base of the bundle feeder 10, five bundles B can be carried. The bundle B is carried on the conveyance base of the bundle feeder 10 so that a short side direction of the strap SB (a short side direction of the paper sheets P) is in parallel with the vertical direction and a direction along which the straps B are laminated (a thickness direction of the paper sheets P) is approximately orthogonal to a transport direction (the transport path L1, X-axis direction) of the bundle B at the bundle feeder 10.

The bundle feeder 10 equips a transport stage (transporter) 11 at an edge part of the side (+X side) to which the bundle B is transferred. The transport stage 11 transports the bundle B1 (transported to an upper face of the transport stage 11) to any of the reject tray 90 and a bundling material remover 20 (explained afterward). In detail, if the controller 80 decides that the bundle B does not satisfy the specification, the transport stage 11 transports the bundle B to the reject tray 90. Furthermore, if the controller 80 decides that the bundle B satisfies the specification, the transport stage 11 transports the bundle B to the bundling material remover 20.

The reject tray 90 is a part to collect the bundle B decided to not satisfy the specification by the controller 80. In the present embodiment, the reject tray 90 is located at one side (−Y direction) of the transport stage 11 along a direction (Y-axis direction) orthogonal to both the transport path L1 and the vertical direction. At the reject tray 90, the bundle B decided to not satisfy the specification is transported from the transport stage 11 along a transport path L7 (Y-axis direction). On the reject tray 90, bundles B not satisfying the specification are collected in order so as to see the respective transport orders.

Figure 6:
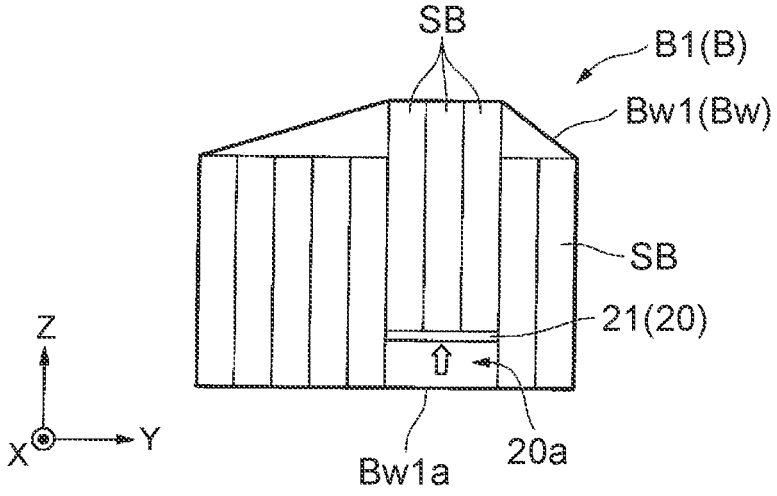
FIG. 6 is a schematic diagram to explain a removing method of a bundling material by a bundling material remover according to one embodiment.

The material remover 6 is a part to remove a material from the bundle B. In the present embodiment, the material remover 6 equips a bundling material remover 20 and a strapping material remover 50. The bundling material remover 20 is a part to remove a bundling material Bw of the bundle B transferred from the bundle feeder 10. The bundling material remover 20 is located at the other side (+Y side) of the transport stage 11 along a direction (Y-axis direction) orthogonal to both the transport path L1 and the vertical direction. At the bundling material remover 20, the bundle B is transferred from the transport stage 11 along a transport path L2 (Y-axis direction). The bundling material remover 20 equips a bundling material cut stage 22. On an upper surface of the bundling material cut stage 22, the bundle B transferred from the transport stage 11 of the bundle feeder 10 is carried. FIG. 6 is a schematic diagram to explain a removing method of the bundling material Bw by the bundling material remover 20. In FIG. 6, the case of removing the bundling material Bw1 of the bundle B1 in FIG. 4 is shown. As shown in FIG. 6, the bundling material remover 20 further equips a lift 21.

The lift 21 is installed onto the bundling material cut stage 22 so as to be movable along the vertical direction (Z-axis direction). On an upper surface of the lift 21, an intermediate part (three straps in FIG. 6) between two bundling materials Bw1 along a long side direction (X-axis direction in FIG. 6) of the bundle B1 (carried on the bundling material cut stage 22) are located. By moving the lift 21 toward the upper side, the lift 21 can lift a part of straps SB located on the upper surface of the lift 21 among all straps SB (ten straps in FIG. 6) composing the bundle B1. In FIG. 6, for example, the lift 21 lifts three straps SB. As a result, a space 20*a* is formed between the bundling material Bw1 and three straps SB lifted along the vertical direction.

The bundling material remover 20 equips a material cutter to cut the bundling material Bw1 and a material removing roller to remove the bundling material Bw1 cut by the material cutter (not shown in FIG. 6). As mentioned above, the bundling material remover 20, the space 20*a* is formed by lifting a part of the straps SB by the lift 21. After that, a part Bw1*a* (of the bundling material Bw1) opposing the space 20*a* along the vertical direction is cut by the material cutter. The material cutter equips a cutter blade rotationally driven. Two bundling materials Bw1 are cut by moving the cutter blade along a long side direction (X-axis direction in FIG. 6) of the straps SB. The material removing roller is pushed onto the bundling material Bw1. By rotating the material removing roller, the bundling material Bw1 (cut by the material cutter) is pulled and removed. As a result, the bundling material remover 20 can separate a plurality of straps SB (composing the bundle B1) into each strap.

In FIG. 3, the strapping material remover 50 is a part to remove the strapping material SBw of each strap SB (separated by the bundling material remover 20) fed via the strap connection part 30 and the strap picking part 40. The strapping material remover 50 equips a strapping material cutter and a strapping material picker (not shown in FIG. 3). By moving the strapping material cutter along a long side direction of the strap SB, the strapping material SBw is cut thereby. The strapping picker inserts a nail thereof into a gap between the strapping material SBw (cut by the strapping material cutter) and the paper sheets P, and pulls out the strapping material SBw by the nail. As a result, the strapping material remover 50 separates the strap SB (a plurality of paper sheets P) into each paper sheet (loose paper sheet).

The strapping material remover 50 transfers the strap SB (loose paper sheets) to the strap stacker 60 along a transport path L5. For example, the transport path L5 extends along a direction (Y-axis direction) orthogonal to the transport path L4 (along which the strap SB is transferred by the strap picking part 40) and the vertical direction. The strapping material remover 50 equips a bar code imaging part to image a bar code SBb put on the strap material SBw (pulled), and an analysis part to analyze the image and update the strap information by deciphering it (not shown in FIG. 3).

The strap connection part 30 is a part to transport the bundle B (separated into a plurality of straps SB by the bundling material remover 20) and connect the bundle B with another bundle B (other straps SB). The strap connection part 30 equips a conveyance base composing the transport path L3 to transport the strap SB. For example, the transport path L3 is in parallel with the transport path L2 and orthogonal to the transport path L1. The strap connection part 30 is located at the opposite side (+Y side) of the transport stage 11 for the bundling material remover 20. The transport stage 11, the bundling material remover 20 (bundling material cut stage 22) and the strap connection part 30, are located in a linearly alignment from a planar view.

The strap SB carried on the conveyance base of the strap connection part 30 is transported along the transport path L3. On the conveyance base of the strap connection part 30, the strap SB (separated from the bundle B by the bundling material remover 20) is manually fed by an operator O2. The strap SB is carried on the conveyance base of the strap connection part 30 so that a short side of the strap SB (paper sheets P) is approximately in parallel with the vertical direction and a long side of the strap SB (paper sheets P) is approximately orthogonal to the transport path L3 (Y-axis direction) of the strap connection part 30. The strap connection part 30 connects a plurality of straps SB (included in different bundles B) while the plurality of straps SB are being transported thereby.

The strap picking part 40 is a part to automatically pick one strap SB from a plurality of straps SB connected by the strap connection part 30. The strap picking part 40 equips a lift to lift one strap SB toward the upper side (not shown in FIG. 3). By lifting the strap SB by the lift, the strap picking part 40 picks one strap SB. The strap picking part 40 transfers the strap SB (picked) to the strapping material remover 50. The transport path L4 to transfer the strap SB to the strapping material remover 50 by the strap picking part 40 is a direction (X-axis direction) orthogonal to both the transport path L3 and the vertical direction.

The strap stacker 60 is a part to stack the strap SB (loose paper sheets by removing the strapping material SBw by the strapping material remover 50) along the vertical direction by dropping the strap SB. Whenever one strap SB (loose paper sheets) is transferred to the strap stacker 60, the strap stacker 60 inserts a secondary batch separator card BC-2 between two straps SB (each having loose paper sheets). In the secondary batch separator card BC-2, information to discriminate the loose paper sheets of one strap is recorded. After stacking a plurality of straps SB (each having loose paper sheets), the strap stacker 60 slides the stacked loose paper sheets along a transport direction L6, and transfers the paper sheets P to the processing machine 100. For example, the transport direction L6 is a direction (X-axis direction) orthogonal to both the transport path L5 and the vertical direction.

The detector 70 is a part to detect information of the bundle B. In the present embodiment, the information of the bundle B includes existence/nonexistence of metallic foreign body, and appearance information of the bundle B. The detector 70 is located at the upstream side more than the material remover 6. In the present embodiment, the detector 70 equips a metal detector 71 and an imaging part 72.

The metal detector 71 is located at the bundle feeder 10. In detail, the metal detector 71 is located so as to surround a circumference of the bundle feeder 10 at the upstream side more than the transport stage 11 of the bundle feeder 10. The metal detector 71 detects whether a metallic foreign body is included in the bundle B (transported along the transport path L1 by the bundle feeder 10). For example, the metallic foreign body is a coin, a pin of a stapler or a clip to staple a plurality of paper sheets P. If the metal detector 71 can detect any metal, component of the metal detector 71 is not limited. For example, the metal detector 71 equips a coil, and has component to detect the metal based on change of magnetic field of electromagnetic induction. Existence/nonexistence of metallic foreign body (detected by the metal detector 71) is output to the controller 80 by a wire or a radio.

The imaging part 72 is located at the bundle feeder 10. In detail, for example, the imaging part 72 is located at the upper side of the transport stage of the bundle feeder 10. The imaging part 72 images the bundle B transported onto the transport stage 11. One imaging part 72 may be installed, or a plurality of imaging parts to image the bundle B from different directions may be installed. Image information of the bundle B by the imaging part 72 is output to the controller 80 by a wire or a radio.

Based on information of the bundle B detected by the detector 70, the controller 80 decides whether the bundle B satisfies a predetermined specification. In the present embodiment, the predetermined specification of the bundle B includes a specification of existence/nonexistence of metallic foreign body, a specification of winding method of the material, a specification of appearance of the material, a specification of position of the material, a specification of the number of materials, a specification of width of the material, a specification of thickness of the material, a specification of quality of the material, and a specification of size of the bundle B. As mentioned above, the controller 80 inputs information of existence/nonexistence of metallic foreign body from the metal detector 71, and inputs image information of the bundle B from the imaging part 72. Based on these information, the controller 80 decides whether the bundle B satisfies the predetermined specification.

As the specification of existence/nonexistence of metallic foreign body, the metallic foreign body is not included. Namely, if the metallic foreign body is not detected from the bundle B by the metal detector 71, the controller 80 decides that the bundle B satisfies the specification of existence/nonexistence of metallic foreign body. On the other hand, if the metallic foreign body is detected from the bundle B by the metal detector 71, the controller 80 decides that the bundle B does not satisfy the specification of existence/nonexistence of metallic foreign body and the specification of the bundle B.

The specification of winding method of the material includes a specification of winding method of the bundling material Bw and a specification of winding method of the strapping material SBw. As the specification of winding method of the bundling material Bw, for example, as the bundling material Bw1 shown in FIG. 4, the bundling material Bw is wound around a short side direction and a thickness direction of a plurality of straps SB, and all straps SB composing the bundle B are bundled by the bundling material Bw. Both conditions need to be satisfied as the specification.

Figure 7:
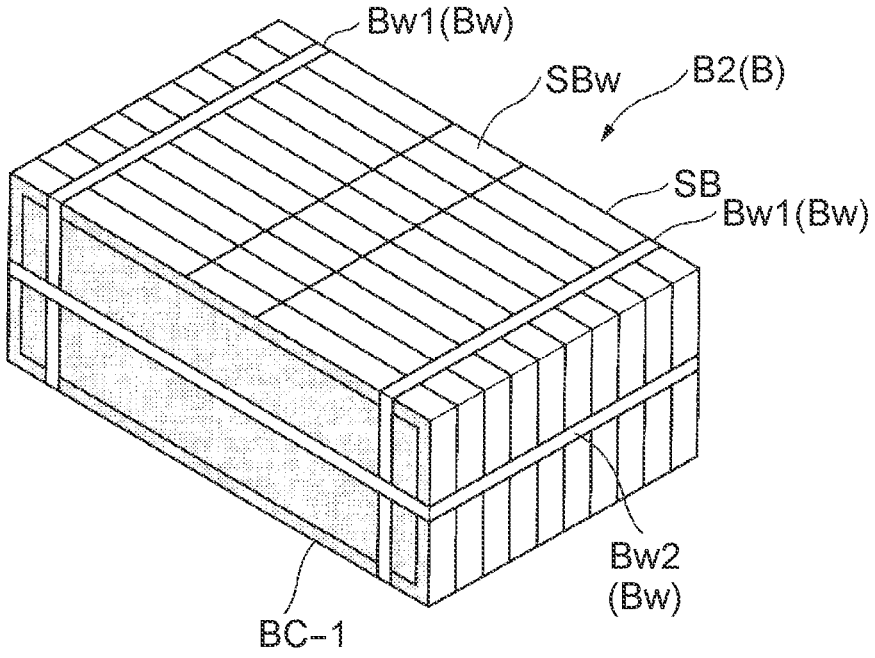
FIG. 7 is a perspective diagram showing the first example of a bundle not satisfying the specification according to one embodiment.
Figure 8:
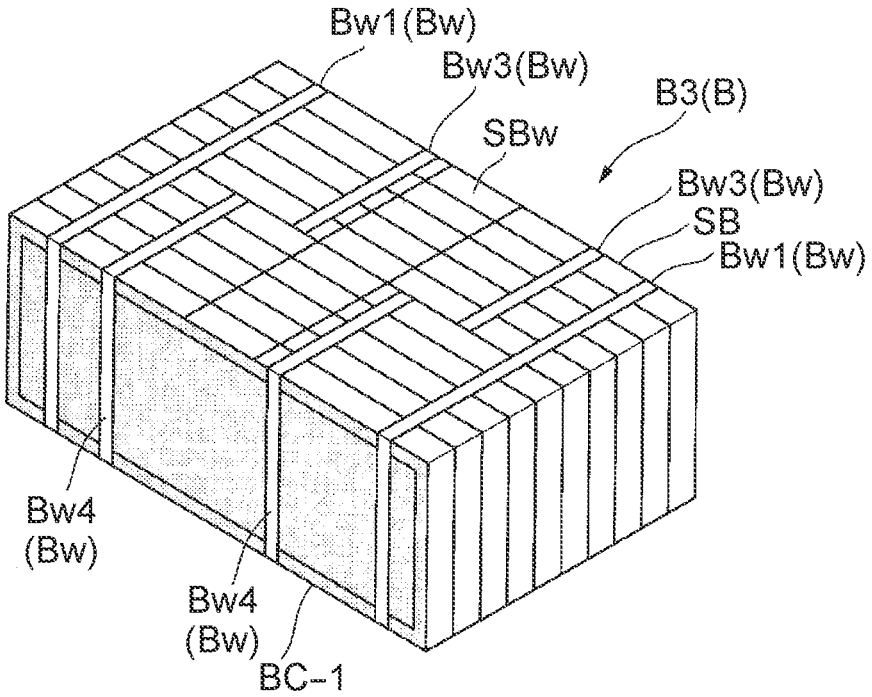
FIG. 8 is a perspective diagram showing the second example of a bundle not satisfying the specification according to one embodiment.

FIGS. 7 and 8 are perspective diagrams showing examples of the bundle B not satisfying the specification according to the present embodiment. In the examples of the bundle B shown in FIGS. 7 and 8, the specification of winding method of the bundling material Bw is not satisfied respectively.

In the bundle B2 shown in FIG. 7, in addition to two bundling materials Bw1 satisfying the specification of winding method of the bundling material Bw, one bundling material Bw2 not satisfying this specification is equipped. The bundling material Bw2 is wound around a long side direction and a thickness direction of a plurality of straps SB. Namely, among above-mentioned requirements of the specification of winding method of the bundling material Bw, the bundle B2 does not satisfy a requirement that the bundling material is wound around a short side direction and a thickness direction of a plurality of straps SB. Accordingly, the bundle B2 does not satisfy the specification of the bundle B.

In the bundle B3 shown in FIG. 8, in addition to two bundling materials Bw1 satisfying the specification of winding method of the bundling material Bw, two bundling materials Bw3 and two bundling materials Bw4 each not satisfying this specification are equipped. Two bundling materials Bw3 are wound around a short side direction and a thickness direction of five straps SB, and bundle the five straps SB. Two bundling materials Bw4 are wound around a short side direction and a thickness direction of other five straps SB, and bundle the other five straps SB. Namely, the bundling materials Bw3 and Bw4 bundle a part of straps SB composing the bundle B3. As a result, among above-mentioned requirements of the specification of winding method of the bundling material Bw, the bundle B3 does not satisfy a requirement that all straps SB (composing the bundle B) are bundled together by the bundling material. Accordingly, the bundle B3 does not satisfy the specification of the bundle B. As to the bundling materials Bw3 and Bw4, for example, respective positions along a long side direction of the straps SB are different mutually.

As a specification of winding method of the strapping material SBw, the strapping material SBw is wound around a short side direction and a thickness direction of a plurality of paper sheets P. The strapping material SBw shown in FIGS. 7 and 8 satisfies this specification.

The controller 80 detects a winding method of the material based on the image information of the bundle B (imaged by the imaging part 72). If the winding method of at least one material is different from above-mentioned predetermined winding method, the controller 80 decides that the bundle B does not satisfy the specification. Namely, if the controller 80 detects that the bundling material Bw and the strapping material SBw are wound around a short side direction and a thickness direction of a plurality of straps SB, the controller 80 decides that the bundle B does not satisfy the specification. Furthermore, if the controller 80 detects that the bundling material Bw bundles a part of straps SB included in the bundle B, the controller 80 decides that the bundle B does not satisfy the specification.

Figure 9:
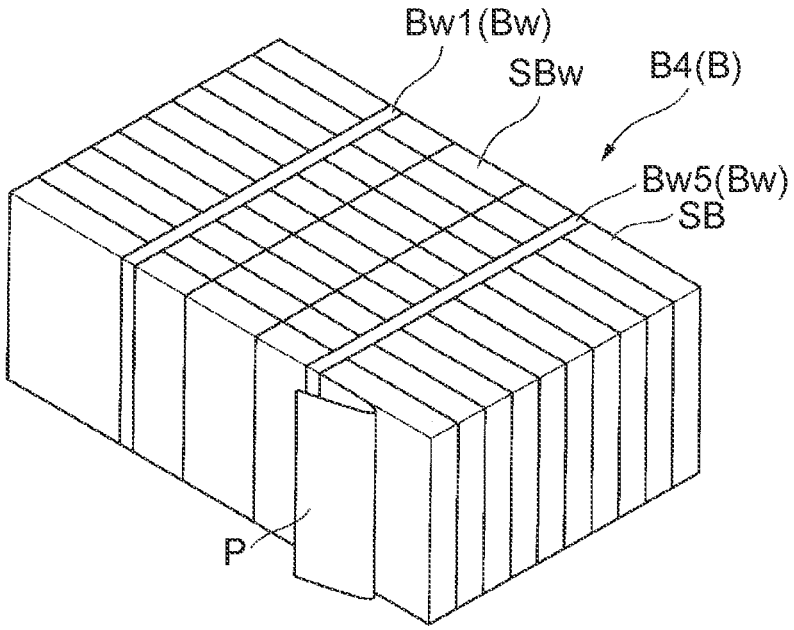
FIG. 9 is a perspective diagram showing the third example of a bundle not satisfying the specification according to one embodiment.

As a specification of appearance of the material, the bundling material Bw is visible over one round thereof from the outside. FIG. 9 is a perspective diagram showing one example of the bundle B not satisfying the specification according to the present embodiment. In the example of the bundle B shown in FIG. 9, the specification of appearance of the material is not satisfied. In the bundle B4 shown in FIG. 9, in addition to one bundling materials Bw1 satisfying the specification of appearance of the material, one bundling material Bw5 not satisfying this specification is equipped. A part of the bundling material Bw5 is covered by a part of the paper sheets P turned up. As a result, a part of the bundling material Bw5 is not visible from the outside. Namely, the bundle 4 does not satisfy a requirement that the bundling material Bw is visible over one round thereof from the outside as above-mentioned specification of appearance of the material. Accordingly, the bundle B4 does not satisfy the specification of the bundle B4.

As the specification of position of the material, a position of the material along a long side direction of the strap SB is within a predetermined range. The specification of position of the material includes a specification of position of the bundling material Bw and a specification of position of the strapping material SBw. As the specification of position of the bundling material Bw, the bundling material Bw is located at a position except for a center part along a long side direction of the straps SB. As the specification of position of the strapping material SBw, the strapping material SBw is located at a center position along a long side direction of the straps SB, or located at a position of which distance from the center position along the long side direction is within a predetermined range.

As the specification of the number of materials, the number of materials is smaller than or equal to the number capable of being cut by the material remover 6. As the specification of width of the material, the width of the material is smaller than or equal to the largest length capable to be cut by the material remover 6. As the specification of thickness of the material, the thickness of the material is smaller than or equal to the largest thickness capable to be cut by the material remover 6.

As the specification of quality of the material, the quality of the material is capable to be cut by the material remover 6. As the quality capable to be cut by the material remover 6, for example, a paper, a rubber, a plastic and so on, are applied. As the plastic, for example, a polypropylene is applied. As the specification of size of the bundle B, the size of the bundle B can be transported to the bundling material remover 20 in the paper sheets preprocessing machine 5, and the bundling material Bw for the size of the bundle B can be removed by the bundling material remover 20.

The winding method of the material, the appearance of the material, the number of materials, the width of the material, the thickness of the material, the quality of the material, and the size of the bundle, are acquired from the image information of the imaging part 72. For example, the controller 80 grasps an outer shape of the material from a shadow occurred at a boundary between each material and the paper sheets P in the image information. As a result, the controller 80 acquires information of the winding method of the material, the appearance of the material, the number of materials, and the width of the material. For example, the controller 80 acquires information of the quality of the material from a color of the material in the image information.

For example, the controller 80 grasps an irregularity shape of an outer surface of the bundle B from the image which the bundle is imaged along a direction orthogonal to the paper sheets P. As a result, the controller 80 acquires information of the thickness of the material. For example, the controller 80 grasps an outer shape of the bundle B from the image which the bundle B is imaged from the upper side. As a result, the controller 80 acquires information of the size of the bundle B.

The controller 80 decides whether the bundle B satisfies the specification from above-mentioned acquired information. If a plurality of specifications is included in the specification of the bundle B as mentioned-above, and if the bundle B does not satisfy at least one of the plurality of specifications, the controller 80 decides that the bundle B does not satisfy the specification. On the other hand, if the bundle B satisfies all of the plurality of specifications, the controller 80 decides that the bundle B satisfies the specification.

As one example, for example, the controller 80 decides whether the bundling material Bw wound the bundle B (composed by straps SB) shapes a straight line from a strap SB at one end of the straps to another strap SB at the other end of the straps. As shown in FIG. 8, as to bundling materials Bw3 and Bw4 each bundling a part of straps SB included in the bundle B, respective positions of the bundling materials Bw3 and Bw4 along a long side direction of the straps SB are often different mutually. Accordingly, by detecting the bundling material Bw not shaping a straight line from a strap SB at one end to another strap SB at the other end, improper bundling material Bw such as the bundling materials Bw3 and Bw4 can be detected.

Furthermore, even if respective positions of the bundling materials Bw3 and Bw4 are same along a long side direction of the straps SB, a shadow occurs at a boundary between two neighboring straps SB of the bundling materials Bw3 and Bw4. Accordingly, while the bundling material Bw is being traced from a strap SB at one end to another strap SB at the other end, by detecting whether the shadow exists at the boundary between two neighboring straps SB of the bundling materials Bw3 and Bw4, improper bundling material Bw such as the bundling materials Bw3 and Bw4 in FIG. 8 can be detected.

Based on a decision whether the bundle B satisfies the specification, the controller 80 controls the transport stage 11 of the bundle feeder 10. If the bundle B is decided to not satisfy the specification, the controller 80 controls the transport stage 11 so as to transport the bundle B to the reject tray 90. If the bundle B is decided to satisfy the specification, the controller 80 controls the transport stage 11 so as to transport the bundle B to the bundling material remover 20.

As shown in FIG. 3, the display part 81 is located at a position easily visible for the operator. The display part 81 displays based on an output signal from the controller 80. If the bundle B is decided to not satisfy the specification by the controller 80, the display part 81 displays a reason to decide that the bundle B does not satisfy the specification. For example, if a metallic foreign body is included in the bundle B, the display part 81 displays characters representing a purport that the metallic foreign body is included in the bundle B. Furthermore, if the metallic foreign body is included in which part of the bundle B by the metal detector 71, by displaying an image of the bundle B on the display part 81, a part of the bundle B including the metallic foreign body may be highlighted.

Furthermore, for example, if the bundle B does not satisfy each specification of the material, the display part 81 displays a purport that the material does not satisfy the specification, characters representing the reason, and an image of the bundle B. On the image of the bundle B, a material not satisfying the specification is highlighted. In this case, any of the characters and the image may be displayed. Furthermore, for example, if the bundle B does not satisfy a specification of size, the display part 81 displays characters representing a purport that the bundle B does not satisfy the specification of size.

Information displayed on the display part 81 is related in order of rejection of the bundle B. Accordingly, the operator O1 can understand that each strap of the rejected straps B is rejected by what reason respectively.

Figure 10:
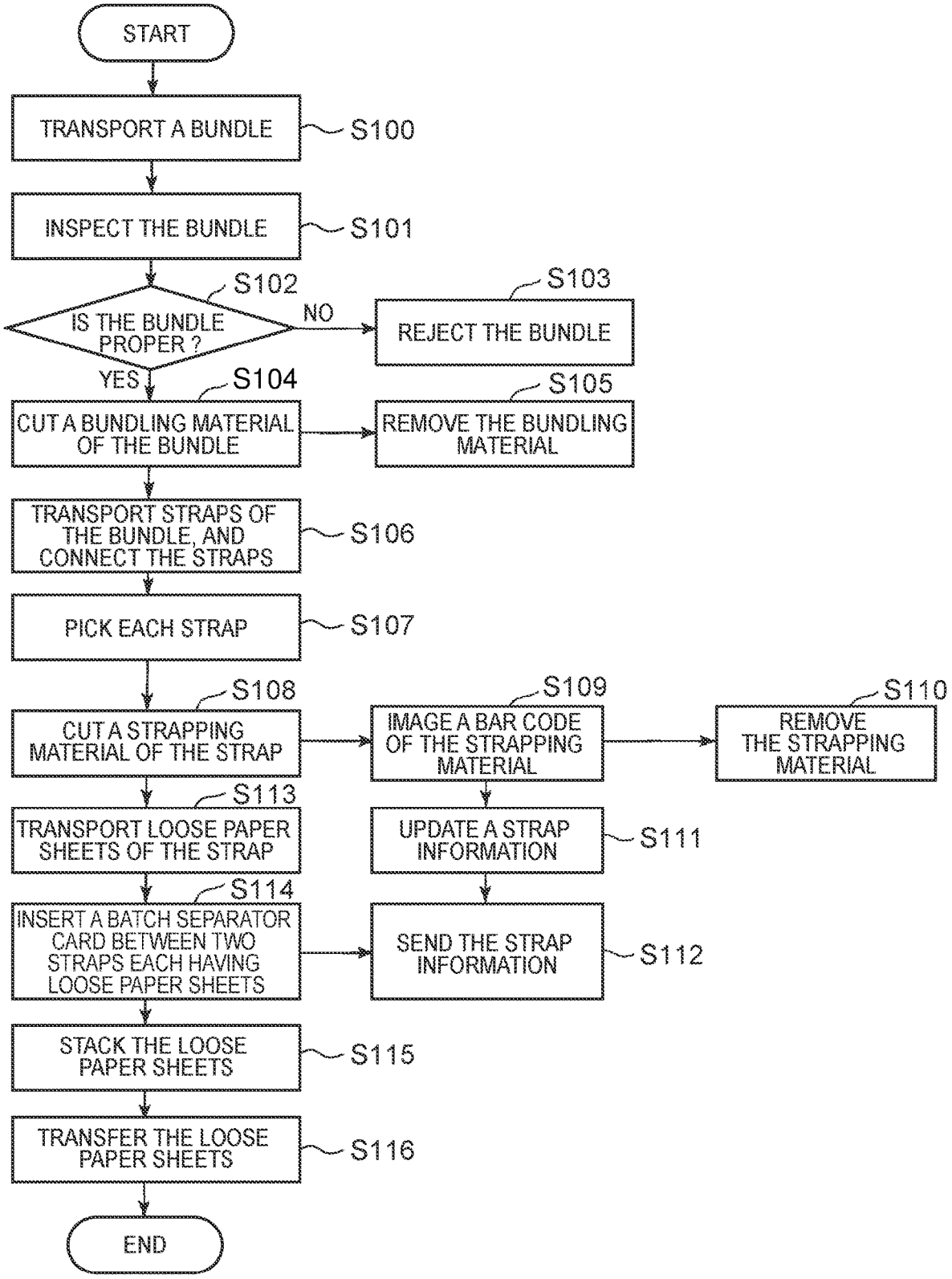
FIG. 10 is a flow chart showing operation of the paper sheets preprocessing apparatus according to one embodiment.

Next, flow of processing of the paper sheets preprocessing machine 5 will be explained. FIG. 10 is a flow chart of operation of the paper sheets preprocessing machine 5 according to one embodiment.

As shown in FIG. 10, the bundle B (carried on the bundle feeder 10 by the operator O1) is transported along the transport path L1 (S100). The bundle B (being transported) is inspected by the detector 70 and the controller 80 (S101). In detail, while the bundle B is being transported along the transport path L1, the bundle B is passing inside of the metal detector 71 and inspected about existence/nonexistence of metallic foreign body. After that, the bundle B is transported to the transport stage 11 and imaged by the imaging part 72 on the transport stage 11. Then, based on information inputted from the metal detector 71 and the imaging part 72, the controller 80 decides whether the bundle B is a proper bundle (satisfy the specification) (S102).

If the bundle B is decided to be an improper bundle (No at S102), the bundle B is transported to the reject tray 90 along the transport path L7 by the transport stage 11, and rejected (S103). Here, the controller 80 controls the display part 81 to display a reason to decide that the bundle B is improper. On the other hand, if the bundle B is decided to be a proper bundle (Yes at S102), the bundle B is transferred to the bundling material cut stage 22 of the bundling material remover 20 along the transport path L2.

In response to the bundle B transferred as one unit, the bundling material remover 20 automatically cuts the bundling material Bw of the bundle B (S104). The bundling material remover 20 removes the bundling material Bw cut thereby (S105). Straps SB of the bundle B of which the bundling material is removed are manually fed to the strap connection part 30 by the operator O2. The straps SB are automatically transported at every predetermined number of straps SB along the transport path L3 by the strap connection part 30. By transporting the predetermined number of straps SB at every (a plurality of) bundles B, the strap connection part 30 connects a plurality of the predetermined number of straps included in the bundles B (S106).

The strap picking part 40 automatically picks each strap SB (one by one) from a plurality of straps SB connected by the strap connection part 30 (S107). The strap picking part 40 transfers each strap SB (picked one by one) to the strap material remover 50 along the transport path L4.

The strap material remover 50 automatically cuts the strap material SBw of one strap SB transferred by the strap picking part 40 (S108). As to the strap SB of which the strapping material SBw is cut, the strapping is loosened, and the strap SB is regarded as loose paper sheets. The strapping material remover 50 transports loose paper sheets of one strap along the transport path L5, and transfers the loose paper sheets of one strap to the strap stacker 60 (S113).

Furthermore, by a bar code imaging part (not shown in FIG. 3), the strapping material remover 50 images a bar code SBb of the strapping material SBw removed from the strap SB (S109). After imaging the bar code SBb on which strap information is printed, the strapping material remover 50 removes the strapping material SBw (S110). The strapping material remover 50 analyzes the image of the bar code SBb, and deciphers strap information. The strapping material remover 50 updates the strap information deciphered (S111).

In response to the loose paper sheets of one strap transferred, the strap stacker 60 inserts a secondary batch separator card BC-2 into (between) two straps each having loose paper sheets (S114). The paper sheets preprocessing machine 5 sends bar code information (printed on the secondary batch separator card BC-2) with the strap information to a banknote processing machine (not shown in FIG. 3) (S112). By dropping the secondary batch separator card BC-2 and the loose paper sheets, the strap stacker 60 stacks them along a thickness direction of the paper sheets P (S115). Whenever the loose paper sheets are transferred from the strapping material remover 50, the strap stacker 60 repeatedly inserts the secondary batch separator card BC-2 and stacks the loose paper sheets. Moreover, the strap stacker 60 may insert the secondary batch separator card BC-2 at every (a plurality of) loose paper sheets. For example, the strap stacker 60 may insert the secondary batch separator card BC-2 at every predetermined number of loose paper sheets included in the bundle B. After stacking the loose paper sheets of a plurality of straps SB, the strap stacker 60 slides the stacked loose paper sheets along the transport direction L6, and transfers them to the processing machine 100 of the paper sheets P (S116).

By repeatedly performing above-mentioned flow, in the paper sheets preprocessing machine 5, a predetermined number of bundles B are set as loose paper sheets (paper sheets P are separated one by one) capable to be fed into the processing machine 100.

Here, as to a bundle B decided to be improper by the controller 80 and rejected into the reject tray 90, after a cause not satisfying the specification is excluded from the bundle B by the operator O1, the bundle B is fed into the paper sheets preprocessing machine 5 again. By referring to the display part 81, the operator O1 excludes the cause not satisfying the specification. Moreover, in order to exclude the cause, if the bundling material Bw needs to be rejected, after cutting and removing the bundling material Bw, the operator O1 may directly feed straps SB (mutually separated) of the bundle B into the strap connection part 30. Above-mentioned processing of the rejected bundle B may be performed after preprocessing of a predetermined number of bundles B is completed, or during preprocessing of the predetermined number of bundles B.

In the method for processing paper sheets according to the present embodiment, as mentioned-above, by the paper sheets preprocessing machine 5, strapping of the bundle B is loosened by removing the material, and paper sheets P of the bundle B are separated one by one. By the processing machine 100, each paper sheet separated from the paper sheets P is inspected.

For example, if a bundle B (to be fed into the paper sheets preprocessing machine 5) does not satisfy a predetermined specification, when the paper sheets preprocessing machine 5 performs preprocessing of the bundle B, or when the processing machine 100 performs processing of the bundle B, defect often occurs. For example, if the bundle B (to be fed into the paper sheets preprocessing machine 5) does not satisfy the predetermined specification, the material of the bundle B cannot be often removed suitably by the material remover 6.

Specifically, such as the bundling material remover 20 of the present embodiment, in the case of component to cut the bundling material Bw by moving a material cutter along a long side direction of the paper sheets P, in the bundle B2 shown in FIG. 7, the bundling material Bw2 cannot be cut and removed. Furthermore, in the bundling material remover 20 of the present embodiment, as shown in FIG. 6, a space 20*a* is formed by lifting a part of straps SB, and the bundling material Bw is cut. In the case of this component, in the bundle B3 shown in FIG. 8, among four bundling materials Bw3 and Bw4, only two bundling materials (Bw3 or Bw4) which bundle the lifted part of straps SB can be cut. Other two bundling materials (Bw4 or Bw3) cannot be removed.

Furthermore, if the bundling material Bw is located at a center position along a long side direction of the strap SB, a space 20*a* is not formed by lifting the bundling material Bw with straps SB by the lift 21. Accordingly, the bundling material Bw cannot be removed. Furthermore, along a long side direction of the paper sheets P, if a position of the strapping material SBw is largely shifted, the strapping material remover 50 cannot cut and remove the strapping material SBw. Furthermore, if the number of materials, a width of the material and a thickness of the material is large, or if a quality of the material is not suitable, the material cannot be often removed by the material remover 6. As one example, if the material is a hemp rope, this material is often hard to be cut and removed.

As mentioned-above, if the material cannot be removed suitably, the operator O1 needs to cope with this defect by temporarily stopping the paper sheets preprocessing machine 5 and by manually rejecting the bundle B. As a result, time and labor required for this operation often increase.

Furthermore, even if both the bundling material Bw and the strapping material SBw are removed from the bundle B, if specification of the paper sheets P bundled is improper, inspection of the paper sheets P by the processing machine 100 cannot be often performed. Specifically, the case that several paper sheets P among the strap SB included in the bundle B are stapled by a pin of a stapler or a clip is applied. In this case, when the paper sheets P are taken out one by one from (preprocessed) loose paper sheets by the processing machine 100, a plurality of paper sheets P stapled by the pin of the stapler or the clip are collectively pulled into the processing machine 100, and the paper sheets P are often jammed. Here, the jammed paper sheets P need to be removed. As a result, time and labor for this operation often increase. Furthermore, due to jam of the paper sheets P, the processing machine 100 is often damaged.

Furthermore, even if the paper sheets P can be taken out one by one by the processing machine 100, if a foreign body is mixed onto one paper sheet P itself or between two paper sheets P, the processing machine 100 is often damaged. Specifically, for example, if a metallic foreign body (such as a pin of a stapler or a clip) is stapled onto one paper sheet P, by moving the one paper sheet P into the processing machine 100, the metallic foreign body is rubbed with a guide plate to guide moving of the paper sheet P, and the guide plate is often damaged. Furthermore, by rubbing the metallic foreign body with a head to read magnetism of the paper sheet P, the head is often damaged. Furthermore, after the paper sheets P is inspected by the processing machine 100, the paper sheets P stapling the metallic foreign body is often recirculated.

Furthermore, among paper sheets P in the bundle B, a coin is sometimes caught in. In this case, the coin is often pulled into the processing machine 100. As a result, the coin is rubbed with a guide plate in the processing machine 100 or a head to read magnetism, the processing machine 100 is often damaged.

In order to resolve above-mentioned detects, in the present embodiment, the detector 70 to detect information of the bundle B is installed at the upstream side than the material remover 6. Based on the information detected by the detector 70, the controller 80 decides whether the bundle B satisfies the specification. Accordingly, the bundle B not satisfying the specification can be rejected before the bundle B is transported to the material remover 6. As a result, above-mentioned defect occurred due to the bundle B not satisfying the specification can be suppressed, and burden to process the paper sheets P can be reduced. As a result, efficiency of preprocessing-operation and efficiency of operation by the processing machine 100 can be improved together.

Furthermore, on the display part 81, a reason to decide that the bundle B does not satisfy the specification is displayed. By watching the display part 81, the operator O1 can easily find a part of the bundle B not satisfying the specification. Accordingly, as for the bundle B not satisfying the specification, a suitable disposition to satisfy the specification can be performed quickly. As a result, time and labor to refeed the rejected bundle B can be reduced, and the operator's burden to process the paper sheets P can be more reduced.

Furthermore, in the present embodiment, the paper sheets preprocessing machine 5 equips the material remover 6 to remove the material from the bundle B. Accordingly, in preprocessing to feed the paper sheets P into the processing machine 100, a burden to remove the material can reduced. Furthermore, in the present embodiment, removal of the material is performed automatically. Accordingly, the preprocessing of the bundle B need not be stopped, and wait time until the paper sheets P are fed can be reduced. As a result, burden to preprocess the paper sheets P can be reduced.

Especially, if a paper sheets assembly is a bundle B as a predetermined number of straps SB (each strap including a plurality of paper sheets P strapped by a strapping material SBw) bundled by a bundling material Bw, after the bundling material Bw is removed, preprocessing to remove the strapping material SBw is necessary. Accordingly, more times and labors are required. Contrary to this, in the present embodiment, the material remover 6 equips the bundling material remover 20 to remove the bundling material Bw and the strapping material remover 50 to remove the strapping material SBw. Accordingly, the bundling material Bw and the strapping material SBw can be removed automatically. As a result, burden to preprocess the paper sheets P can be further reduced.

Furthermore, in the present embodiment, the detector 70 is located at the upstream side than both the bundling material remover 20 and the strapping material remover 50. Accordingly, improper bundles B can be collectively rejected at the upstream side. As a result, while component of the paper sheets preprocessing machine is simplified, the bundle B not satisfying the specification can be effectively rejected.

Furthermore, in the present embodiment, the detector 70 equips the imaging part 72, and appearance information of the bundle B is detected from the image. Accordingly, respective information such as an appearance of the material, a position of the material, the number of materials, a winding method of the material, a width of the material, a thickness of the material, and a quality of the material, can be acquired. As a result, the bundle B from which the material is hard to be removed can be rejected more suitably, and efficiency of preprocessing-operation can be more improved.

Furthermore, as the improper bundle B, the winding method of the material is often improper. Accordingly, by detecting the winding method of the material from the image and by comparing the winding method with the specification, the improper bundle B can be rejected more effectively. Especially, as the improper bundle B, the bundle B including the bundling material Bw (such as bundling materials Bw3 and Bw4 shown in FIG. 8) not satisfying the specification is often applied. Contrary to this, in the present embodiment, when the bundling material Bw to bundle a part of straps SB included in the bundle B is detected, the controller 80 decides that the bundle B does not satisfy the specification. Accordingly, the bundle B3 shown in FIG. 8 can be rejected as the improper bundle B. As a result, the improper bundle B can be rejected more effectively.

Furthermore, for example, as shown in FIG. 9, a bundling material Bw5 is covered by a paper sheet P turned up, and the bundling material Bw5 is adhered with the paper sheet P. In this case, when the bundling material Bw5 is removed, the paper sheet P is often rolled up with the bundling material Bw5. Contrary to this, in the present embodiment, by acquiring appearance information of the material, the bundle B of which a part of the material is not exposed can be detected. As a result, the controller 80 decides this bundle B (of which a part of the material is not exposed) as a bundle not satisfying the specification, and the bundle B having the material adhered with the paper sheet P can be rejected. Furthermore, a size of the bundle B can be also detected from image information of the imaging part 72. Accordingly, when a bundle B of which size cannot be processed by the bundling material remover 20 is fed into the bundle feeder 10, this bundle B can be rejected.

Furthermore, in the present embodiment, the detector 70 equips the metal detector 71, and can detect whether a metallic foreign body is included in the bundle B. If the detector 70 detects that the metallic foreign body is included in the bundle B, the controller 80 decides that the bundle B does not satisfy the specification. Accordingly, the bundle B into which a coin, a pin of a stapler or a clip is mixed can be rejected. As a result, efficiency of operation by the processing machine 100 can be further improved, and damaging of the processing machine 100 can be further suppressed.

Furthermore, in the present embodiment, when the controller 80 decides that the bundle B does not satisfy the specification, the transport stage 11 transports the bundle B to the reject tray 90. Accordingly, the bundle B not satisfying the specification is rejected automatically. As a result, a burden for the operator O1 to reject the bundle B can be reduced. Furthermore, by stacking improper bundles into the reject tray 90 collectively, when a cause not to satisfying the specification is excluded from a plurality of improper bundles B, the operator O1 can operate effectively.

Figure 11:
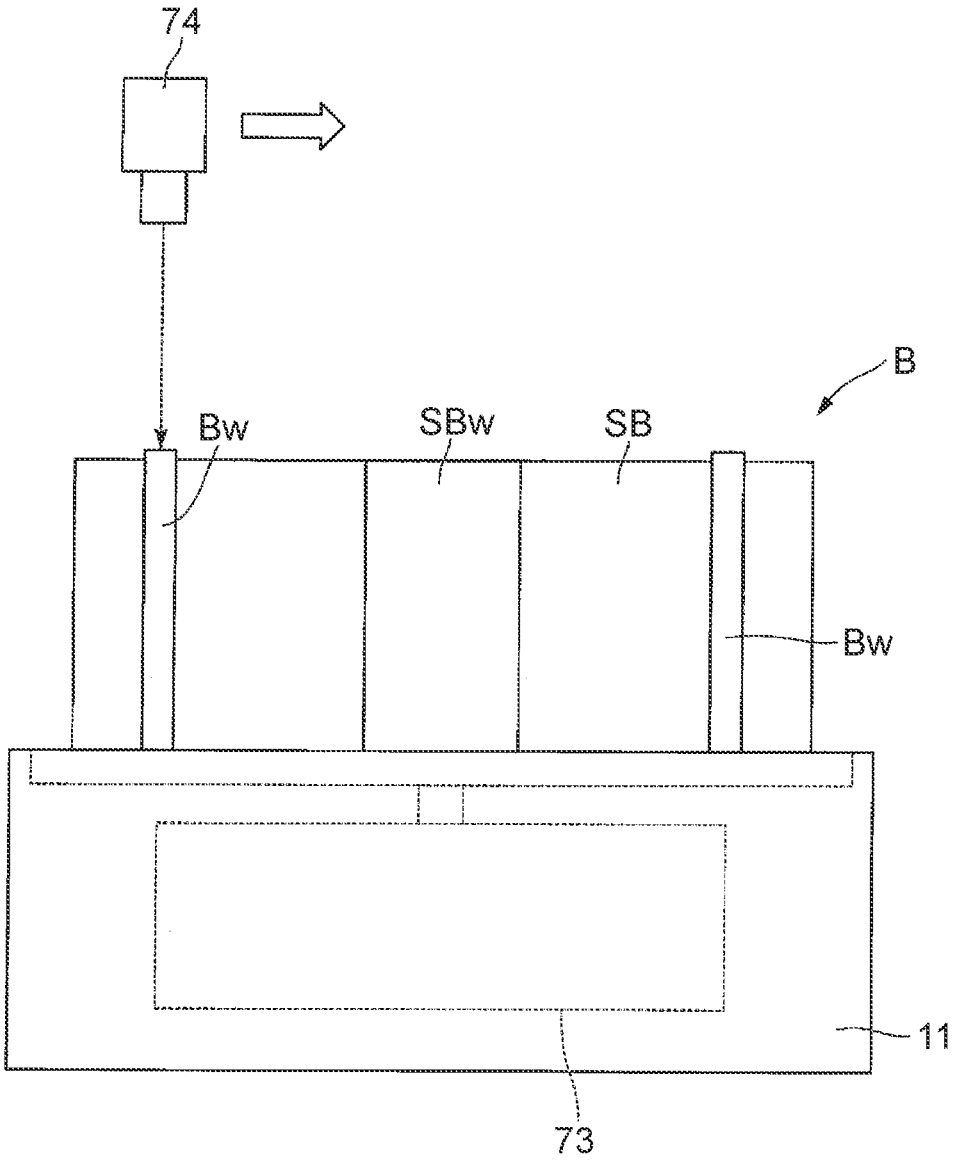
FIG. 11 is a schematic diagram showing another example of a detector according to one embodiment.

Moreover, in above-mentioned embodiment, the detector 70 equips the metal detector 71 and the imaging part 72. However, the detector 70 is not limited to this component. FIG. 11 is a schematic diagram showing another example of the detector 70 according to one embodiment. As shown in FIG. 11, the detector 70 may equip a weight measurement part 73 to measure a weight of the bundle B. In this case, information of the bundle B detected by the detector 70 includes a weight of the bundle B. For example, the weight measurement part 73 is installed into the transport stage 11. As a result, while the bundle B (transported on the transport stage 11) is being imaged by the imaging part 72, a weight of the bundle B can be measured. In this case, for example, if the weight of the bundle B (measured by the weight measurement part 73) is larger than a predetermined value, the controller 80 decides that the bundle B does not satisfy the specification.

For example, if the paper sheets P includes moisture, the paper sheets P are mutually adhered, and each of the paper sheets P cannot be suitably taken out from (stacked) loose paper sheets by the processing machine 100. A weight of the paper sheets P including moisture is larger than a weight of the (regular) paper sheets P. Accordingly, if the weight of the bundle B is larger than the predetermined value, the controller 80 decides that the bundle B does not satisfy the specification. As a result, the bundle B bundling the paper sheets P including moisture can be rejected.

Furthermore, for example, if the number of straps SB included in respective bundles B (fed) are different, the number of straps SB is recognized from the image information acquired by the imaging part 72, and a weight of the bundle B acquired by the weight measurement part 73 is compared with a weight of the bundle B in proportion to the number of straps SB. As a result, the controller 80 can decide the bundle B bundling the paper sheets P including moisture.

Furthermore, the detector 70 may equip a displacement measurement part 74 to measure a displacement of an outer surface of the bundle B. The displacement measurement part 74 shown in FIG. 11 is, for example, a laser displacement gauge to radiate a laser toward an outer surface of the bundle B and measure a displacement of the outer surface. The displacement measurement part 74 is, for example, located at the upper side of the transport stage 11. While the displacement measurement part 74 is being moved along a long side direction of the strap SB, and the displacement measurement part 74 measures a displacement of the outer surface of the bundle B. Moreover, the displacement measurement part 74 may be, for example, located on the transport path L1 of the bundle feeder 10. The displacement measurement part 74 may be, for example, installed with the metal detector 71. The controller 80 detects a thickness of the material based on the detection result of the displacement measurement part 74. If the thickness of the material is larger than a predetermined value, the controller 80 decides that the bundle B does not satisfy the specification. In this way, by detecting the thickness of the material, the thickness of the material can be measured accurately. Accordingly, the bundle B having the material hard to be removed by the material remover 6 can be rejected more suitably.

Furthermore, the detector 70 may equip any of the metal detector 71, the imaging part 72, the weight measurement part 73 and the displacement measurement part 74, equip any two or any three combinations therefrom, or equip all four parts thereof. For example, component of the detector 70 can be suitably selected, based on the case that many bundles B (fed into the processing machine 5) do not satisfy which specification. Furthermore, as above-mentioned embodiment, if a plurality of materials of different types is set, the detector 70 may have component to detect information of a part of the materials. In the example of above-mentioned embodiment, the detector 70 may have component to detect information of the strapping material SBw among the bundling material Bw and the strapping material SBw. In this case, the detector 70 may be located at the downstream side of the bundling material remover 20 and the upstream side of the strapping material remover 50.

Furthermore, by installing a plurality of reject trays 90, the bundles B may be distributed by respective reasons to decide that the specification is not satisfied, and respectively rejected into one reject tray (of the reject trays 90) corresponding to one reason to decide that the bundle does not satisfy the specification. Furthermore, as long as a plurality of paper sheets P included in a paper sheets assembly is strapped by the material, the paper sheets assembly is not limited. The paper sheets assembly may be the strap SB.

According to above-mentioned embodiment, the detector 70 to detect information of the bundle B is located at the upstream side than the material remover 6. Based on the information detected by the detector 70, the controller 80 decides whether the bundle B satisfies the specification. Accordingly, the bundle B not satisfying the specification can be rejected before the bundle B is transported to the material remover 6. As a result, occurrence of above-mentioned defects due to the bundle B not satisfying the specification can be suppressed, and burden to process the paper sheets P can be reduced. Furthermore, efficiency of preprocessing-operation and efficiency of operation by the processing machine 100 can be improved together.

Furthermore, according to above-mentioned embodiment, the display part 81 displays a reason to decide that the bundle B does not satisfy the specification. By watching the display 81, the operator O1 can easily find a part of the bundle B not satisfying the specification. Accordingly, as for the bundle B not satisfying the specification, a suitable disposition to satisfy the specification can be performed quickly. As a result, time and labor to refeed the rejected bundle B can be reduced, and the operator's burden to process the paper sheets P can be more reduced.

Furthermore, according to above-mentioned embodiment, the material remover 6 to remove the material from the bundle B is equipped. Accordingly, in preprocessing to feed the paper sheets P into the processing machine 100, burden to remove the material can be reduced. Furthermore, according to above-mentioned embodiment, removal of the material can be performed automatically. Accordingly, the preprocessing of the bundle B need not be stopped, and wait time until the paper sheets P are fed can be reduced. As a result, burden to preprocess the paper sheets P can be reduced.

Especially, the material remover 6 equips the bundling material remover 20 to remove the bundling material Bw and the strapping material remover 50 to remove the strapping material SBw. Accordingly, the bundling material Bw and the strapping material SBw can be removed automatically. As a result, burden to preprocess the paper sheets P can be further reduced.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for preprocessing paper sheets, comprising:

a material remover that removes a material from a paper sheets assembly including a plurality of paper sheets strapped by the material;

a detector located at an upstream side than the material remover along a transport path to transport the paper sheets assembly, that detects an information of an assembly condition of the paper sheets assembly;

a strap connection part that transports the paper sheets assembly along the transport path;

a controller that decides whether the paper sheets assembly satisfies a predetermined specification, based on the information detected by the detector; and a display, if the controller decides the paper sheets assembly does not satisfy the predetermined specification, that displays a reason to decide the paper sheets assembly does not satisfy the predetermined specification, wherein the detector equips an imaging part that images the assembly condition of the paper sheets assembly, the material includes a strapping material to strap the plurality of paper sheets as a strap, and a bundling material to bundle a plurality of straps as a bundle, the paper sheets assembly is the bundle, the material remover equips a bundling material remover that removes the bundling material from the bundle, and a strapping material remover that removes the strapping material from the strap, the bundling material remover is located at a start point of the strap connection part along the transport path, the strapping material remover is located at an end point of the strap connection part along the transport path, and the strap connection part connects a plurality of straps separated from different bundles by the bundling material remover, while the plurality of straps are being transported along the transport path.

2. The apparatus according to claim 1, wherein the controller detects a winding method of the material based on an image information of the paper sheets assembly imaged by the imaging part, and, if the winding method is different from a predetermined winding method, decides the paper sheets assembly does not satisfy the predetermined specification.

3. The apparatus according to claim 2, wherein the detector equips a metal detector that detects whether the paper sheets assembly includes a metallic foreign body, and if the metal detector detects the paper sheets assembly includes the metallic foreign body, the controller decides the paper sheets assembly does not satisfy the predetermined specification.

4. The apparatus according to claim 1, wherein the detector equips a weight measurement part that measures a weight of the paper sheets assembly.

5. The apparatus according to claim 1, wherein the detector equips a displacement measurement part that measures a displacement of an outer surface of the paper sheets assembly.

6. The apparatus according to claim 1, further comprising: a stacker that stacks the paper sheets assembly decided to not satisfy the predetermined specification by the controller; and a transport part having the transport path, that transports the paper sheets assembly to the stacker if the controller decides the paper sheets assembly does not satisfy the predetermined specification, and transports the paper sheets assembly to the material remover if the controller decides the paper sheets assembly satisfies the predetermined specification.

7. The apparatus according to claim 1, wherein the controller decides the bundle does not satisfy the predetermined specification if the detector detects the bundling material bundles a part of the straps included in the bundle.

8. A method for processing paper sheets by a processing machine for inspecting the paper sheets, the method comprising:

providing the apparatus of claim 1;

loosening by the apparatus, a strapping of the paper sheets assembly by removing the material;

separating by the apparatus, the paper sheets included in the paper sheets assembly into each paper sheet; and inspecting by the processing machine, the each paper sheet.

* * * * *